United States Patent [19]

Viebrantz

[11] Patent Number: 4,493,959

[45] Date of Patent: Jan. 15, 1985

[54] KEYBOARD WITH IMPROVED KEY DESIGN PERMITTING TILTING ABOUT EITHER SIDE

[75] Inventor: Hans-Joachim Viebrantz, Bad Neustadt/Saale, Fed. Rep. of Germany

[73] Assignee: Preh Elektrofeinmechanische Werke Jakob Preh Nachf., GmbH & Co., Bad Neustadt/Salle, Fed. Rep. of Germany

[21] Appl. No.: 472,637

[22] Filed: Mar. 7, 1983

[30] Foreign Application Priority Data

Mar. 10, 1982 [DE] Fed. Rep. of Germany ..... 3208559

[51] Int. Cl.[3] ..... H01H 13/14

[52] U.S. Cl. ..... 200/340; 200/159 B

[58] Field of Search ..... 200/5 A, 159 A, 159 B, 200/159 R, 340, 330

[56] References Cited

U.S. PATENT DOCUMENTS

| | | | |
|---|---|---|---|
| 3,860,771 | 1/1975 | Lynn et al. | 200/340 |
| 4,255,635 | 3/1981 | Campbell et al. | 200/340 |

FOREIGN PATENT DOCUMENTS

| | | | |
|---|---|---|---|
| 1163425 | 2/1964 | Fed. Rep. of Germany | 200/159 R |
| 2459464 | 6/1975 | Fed. Rep. of Germany . | |
| 2556118 | 6/1976 | Fed. Rep. of Germany . | |
| 3000228 | 7/1980 | Fed. Rep. of Germany . | |

*Primary Examiner*—John W. Shepperd

*Attorney, Agent, or Firm*—Woodcock, Washburn, Kurtz, Mackiewicz & Norris

[57] ABSTRACT

In a keyboard comprising keys (1) arranged in recesses of a supporting plate (2) and electric contacts of a contact plate (6) disposed below the keys (1) a tilting axis is provided between the key (1) and the supporting plate (2). In order to ensure symmetrical switching behavior a tilting axis is provided on both sides of the key (1). The tilting axes are formed by corners (4, 5) which are abutted at an obtuse angle (W2) by the key (1).

8 Claims, 1 Drawing Figure

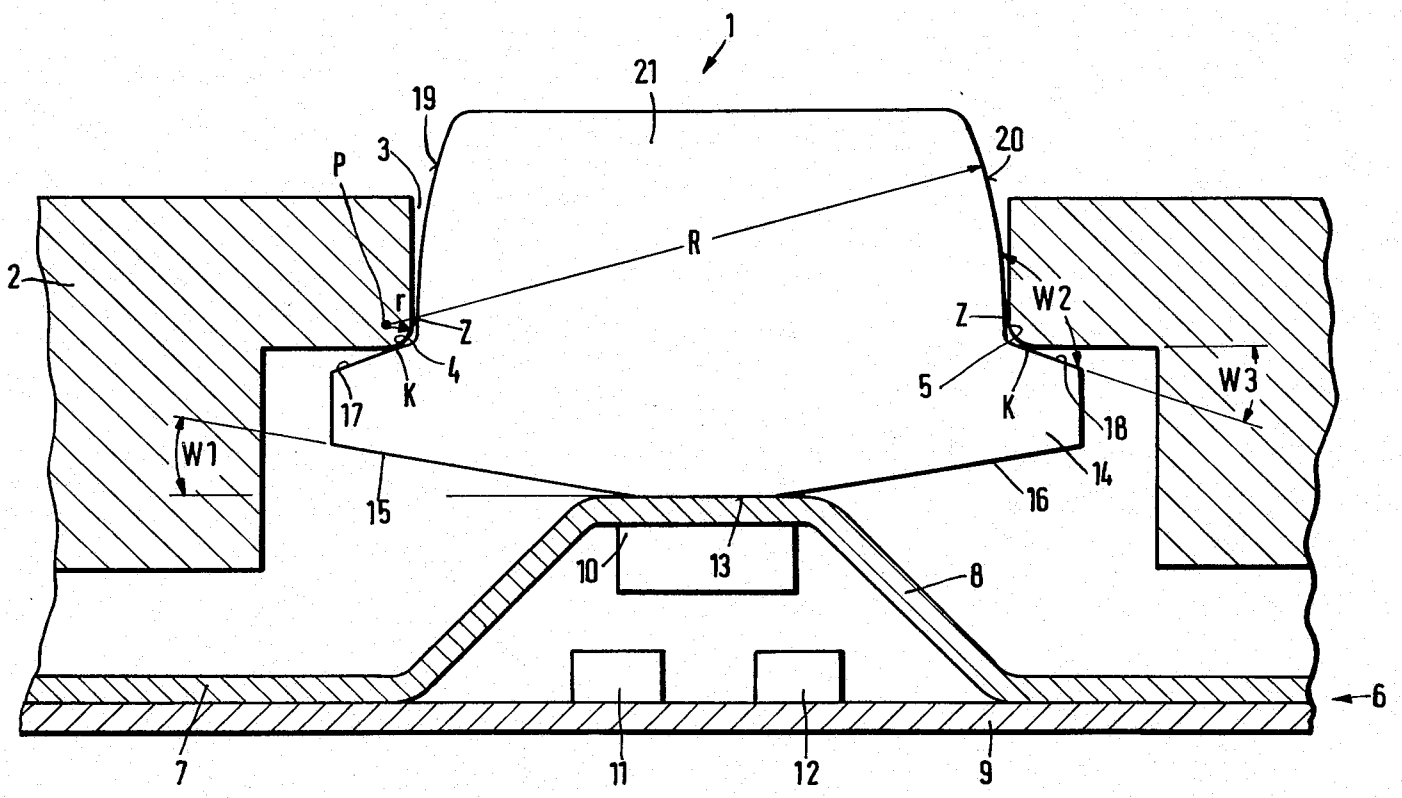
1
2
3
4
5
6
7
8
9
10
11
12
13
14
15
16
17
18
19
20
21
R
r
P
K
Z
W1
W2
W3

KEYBOARD WITH IMPROVED KEY DESIGN PERMITTING TILTING ABOUT EITHER SIDE

BACKGROUND OF THE INVENTION

1. Field of the Invention

This invention concerns a keyboard comprising keys arranged in recesses of a supporting plate with electric contacts of a contact plate disposed below the keys. A tilting axis is provided between the key and the supporting plate. The lateral surface of the key top opposite the tilting axis is recessed for tilting action and the base of the key is placed under the resilient force of the contact.

2. Description of the Prior Art

A keyboard of this kind is described in German published application No. 2,459,464. In this keyboard the keys are embodied in a single unit with the supporting plate. The tilting axis forms a connector between the key and the supporting plate.

The keyboard according to German published application No. 2,459,464 has the drawback that the movement of the keys is not symmetrical, with the result that the operational behaviour in the case of pressure on one side of the key is different from that in the case of a pressure on the other side of the key.

SUMMARY OF THE INVENTION

It is therefore the object of the invention to provide a keyboard of the type described above in which the keys tilt symmetrically when pressed from different sides.

According to the invention this object is solved in the case of a keyboard of the type described above in that a tilting axis is provided on both sides of the key. The key has a recess on each side, defining an obtuse angle formed between the lateral surface of the key and a stopper surface of the key base projecting opposite the key top below the supporting plate. The tilting axis is formed by the tangent where the stopper surface abuts a corner of the supporting plate.

The tilting and hence the switching behaviour of the key is the same irrespective of whether it is operated more on the one side or more on the other side. In the first case the key tilts about one tilting axis without the tilting being affected by the other tilting axis. In the second case the key tilts about the other tilting axis. At the same time a lever action is brought about. The design of the tilting axes does not incur any additional restoring forces which have to be overcome in operation and which might lead to different operating forces of the individual keys in the keyboard. The necessary operating force is dependent only on the design of the contact plate.

In a preferred embodiment of the invention the stopper surfaces are at an acute angle to the plane of the supporting plate when the key is not operated. This ensures that the tilting axis will not slip during operation of the key. The acute angles are preferably dimensioned such that the stopper surface abuts the supporting plate when the contact is closed. This does not influence the action point behaviour of the contact plate.

BRIEF DESCRIPTION OF THE DRAWING

Further advantageous embodiments of the invention will become apparent from the following description and from the claims. The drawing shows a sectional view of a portion of a keyboard, illustrating the configuration of a key in relation to the supporting plate and contact plate of the keyboard.

DETAILED DESCRIPTION OF THE PREFERRED EMBODIMENT

The drawing shows only one key 1 on the keyboard. Depending on the application the keyboard may have a plurality of similar keys arranged in a mutual plate 2.

The supporting plate 2 is provided with a recess 3 in which the key 1 is seated. The supporting plate 2 comprises corners 4 and 5 in the recess 3. A contact plate 6 is arranged below the supporting plate 2.

The contact plate 6 includes an upper rubber membrane 7 with domes 8 and a printed circuit board 9 which is fixed below the upper rubber membrane 7. A bridging contact 1 is glued in position in the dome 8 and it connects two electric contact tracks 11 and 12 of the printed circuit board 9 when the dome 8 is depressed.

The key 1 sits in the recess 3 and abuts the dome 8 with a central point of contact 13 of its base 14.

The base 14 protrudes below the supporting plate 2. The base 14 extends from the point of contact 13 in bevels 15 and 16 which are at an angle W1 to the plane of the supporting plate 2.

The base 14 develops from stopper surfaces 17 and 18 to lateral surfaces 19 and 20 of a top 21 of the key 1. The stopper surface 17 and the lateral surface 19 and the stopper surface 18 and the lateral surface 20 respectively form an obtuse angle W2 in the transition regions. The transition regions are pressed against the corners 4 and 5 respectively by the resilient force of the dome 8.

In the embodiment example the corners 4 and 5 extend in a radius r about a point P. In the embodiment example the radius r is substantially larger than that of a curve in the vertex of the angle W2. This ensures that both the stopper surfaces 17 and 18 and also the lateral surfaces 19 and 20 of the key have tangents to the corners 4 and 5 respectively. The tangent K of the stopper surfaces 17 and 18 respectively becomes effective as a tilting axis when the key 1 is pressed. The tangent Z of the lateral surfaces 19 and 20 respectively becomes effective when the key 1 is restored to its initial position and it improves the centering of the key 1 in its initial position. The stopper surfaces 17 an 18 form and acute angle W3 with the plane of the supporting plate 2. The acute angles W1 and W3 are approximately equal and amount, by way of example, to 12°. The lateral surfaces 19 and 20 are bent about the point P in a radius R. The radius R is dimensioned such that the lateral surfaces 19 and 20 do not abut the edge of the recess 3 before the bridging contact 10 has connected the contact tracks 11 and 12.

The manner of functioning of the described apparatus is approximately as follows:

When the key top 21 is pressed in the region shown on the right of the figure it tilts about the tilting axis formed by the tangent K of the stopper surface 17. In so doing, the nap 8 is pressed by the point of contact 13 until the bridging contact 10 connects the electric contact tracks 11 and 12. It is only after the tilting motion has carried through about the angle W3 that the stopper surface 17 abuts the supporting plate 2 from below. The bevel 16 permits the necessary stroke of the key without allowing the key to strike the upper rubber membrane 7 before the stroke has been completed. After the key top 21 is released the key 1 is moved back into the position as shown by the restoring force of the dome 8 and is centered on the tangent Z of the lateral surfaces 19 and 20.

When the key top 21 is pressed on the side shown left in the drawing it tilts about the tangent K of the stopper surface 18 in the same manner as described above. The switching behaviour and the necessary pressing force is the same in both cases.

When the key top 21 is pressed in the middle the vertices on both sides may become removed from the corners 4 and 5 or from the two tangents Z. The dome 8 is depressed by the point of contact 13.

In a further embodiment of the invention the corners 4 and 5 may be embodied to be sharp-edged in such a way that the tangents K and Z practically coincide. In this case their corners 4 and 5 are directly in the vertex of the obtuse angles W2 formed between the stopper surfaces 17 and 18 and the lateral surfaces 19 and 20 respectively.

What is claimed is:

1. A keyboard comprising a supporting plate with recesses therein and keys arranged in said recesses, a contact plate positioned below said keys and resilient contact means positioned on said contact plate below each said key for providing a resilient force against said key when it is pressed down against said contact means to make an electrical contact, characterized in that:

each said recess comprises an opening in said plate, said plate having a pair of corners on opposite sides at the bottom of said opening, each said key has a top portion which normally extends up through said opening and has opposite lateral surfaces which curve inwardly from said opening in going from bottom to top, and a base portion which extends below said corners and has opposite stopper surfaces which extend laterally outwardly and downward from said opening, said lateral surfaces and stopper surfaces on each side of said key defining obtuse angles which normally abut respective ones of said corners, the bottom of said base portion being in contact with said contact means, whereby when said key is pressed down at an angle it tilts about a tilting axis formed at the contact point of one of said stopper surfaces with the respective one of said corners.

2. The keyboard according to claim 1, wherein said lateral surface and stopper surface on each side of said key are joined in a key curve of a first radius, and each said corner comprises a curve of a second radius which is larger than said first radius, whereby each said stopper surface and each said lateral surface abuts the respective corner tangentially.

3. The keyboard according to claim 2, characterized in that the resilient force of said contact means normally maintains said key curves in abutment with said corners.

4. The keyboard according to any of claims 2, 3 and 1, characterized in that said supporting plate has an upper surface which defines a plane and a lower surface contiguous to said corners which is parallel to said plane, and wherein said stopper surfaces are normally at an acute angle to said lower surface plane when said key is not pressed downward.

5. The keyboard according to any of claims 2, 3 and 1, characterized in that said lateral surfaces are curved with a predetermined radius, whereby there is a clearance between said key and said recess opening at the top of said wall.

6. The keyboard according to any of claims 2, 3 and 1, characterized in that the bottom of said key base portion has a contact surface for contacting said contact means, said key base having beveled surfaces extending from said contact surface upwardly and radially outwardly.

7. The keyboard according to claim 6, characterized in that the stopper surface has an acute angle with respect to the bottom of said supporting plate, and the angle of said bevel surface with respect to the plane of said keyboard is substantially equal to said acute angle.

8. A keyboard comprising a plurality of keys and a supporting plate having recesses in which the keys are arranged, a contact plate disposed below said keys, each said key having a base, and a contact on said contact plate below each said key which provides resilient force against said key base when said key is pressed against said contact, further comprising:

each said key having a top portion extending through a respective recess and having on opposite sides thereof a lateral surface recessed so as to curve inwardly away from its plate recess toward the top of the key to permit tilting action about either side of said key, and a stopper surface projecting from each opposite side of said key below said supporting plate and with a slope away from said plate, adjacent said lateral surfaces and stopper surfaces being joined at a vertex therebetween, said plate forming a corner on each lower side of said plate recess, each said corner normally abutting each said vertex, and the tangent of each said stopper surface where it abuts the respective corner defining a tilting axis.

* * * * *